United States Patent [19]

Campione

[11] 4,407,523

[45] Oct. 4, 1983

[54] BOOK HOLDER

[76] Inventor: A. Peter Campione, 32 Jones St., New York, N.Y. 10014

[21] Appl. No.: 338,421

[22] Filed: Jan. 11, 1982

[51] Int. Cl.[3] ..... B42D 17/00; A47B 97/04

[52] U.S. Cl. ..... 281/46; 248/453

[58] Field of Search ..... 281/45, 33, 46–48; 402/77, 73; 248/445, 451, 452, 453, 455, 456, 465

[56] References Cited

U.S. PATENT DOCUMENTS

| | | | |
|---|---|---|---|
| 1,245,206 | 11/1917 | Drews | 281/33 |
| 1,923,351 | 8/1933 | Woodley | 281/33 |
| 3,128,108 | 4/1964 | Finch | 281/33 |
| 3,747,889 | 7/1973 | Gerald | 248/451 |
| 3,813,075 | 5/1974 | Capper | 248/461 |
| 3,952,989 | 4/1976 | Hatcher | 248/453 |
| 4,116,414 | 9/1978 | Robertson | 248/451 |
| 4,123,029 | 10/1978 | Gillotti | 248/453 |
| 4,127,253 | 11/1978 | Ben-Lea | 248/453 |
| 4,150,807 | 4/1979 | Manso | 248/452 |

*Primary Examiner*—Gil Weidenfeld
*Assistant Examiner*—John S. Brown

[57] ABSTRACT

This device consists primarily of an upright backing member, called a backrest, having a perpendicular lip extending out from its base in a forward direction, and located at the inside bend of said perpendicular lip and backrest, is a spacer upon which an open book's weight is supported at its lower edges while its covers lean against said backrest. Along the lower margins and covering the entire width of the book's open pages, is held a flat rectangular plate of transparent material, which is simultaneously exerting a pressing force in a rearward direction against the open pages, this force is generated by means of elastic cords located at both the right and left ends of the flat plate, said cords are threaded through holes in the flat plate and bypass the book's page edges, then passing through similar holes in the backrest, they are terminated and held securely in the rear of backrest by means of knots in the cord ends, the knotting effect being enhanced by means of flat washers surrounding the finished knots. The backrest and its associated parts as an assembly is supported on a flat table or surface in a rearwardly inclined vertical position by means of a rear supporting plate projecting horizontally rearward in a direction perpendicular to the backrest, and is attached to the backside of the backrest by means of two bolts and wing nuts.

2 Claims, 4 Drawing Figures

BOOK HOLDER

BACKGROUND OF THE INVENTION

This invention relates to book holders and more specifically to that class of apparatus which not only supports an open book, but also keeps the open pages flat and readable by a mechanical means.

It is the intent of this invention to provide a book holding device that keeps the open pages flat, does not obscure the printed matter, leaves the reader's hands free to be occupied with other matters like copying data, yet makes the task of turning a page simple and not an endangerment to the book's page.

PRIOR ART

Prior art includes many book holders that not only support a book in an upright position but also keeps the open pages flat enough to read, by some mechanical means. As shown in the following patented devices, there are many ways of holding the book's pages in an open flat position.

U.S. Pat. No. 4,150,807 utilizes a pair of elevatable hooks situated along the top margin of the open book; the left hook holds down the left page with a spring as a pressure pointer, and the right hook holds down the right page without a spring pointer.

U.S. Pat. No. 4,123,029 utilizes two page gripping brackets situated along the bottom margin of the open book, that keeps a spring loaded pressure against the open pages, one for the left page, independent from the one for the right page.

U.S. Pat. No. 4,127,253 utilizes finger-like springs that apply pressure along the top margin of each open page.

U.S. Pat. No. 4,116,414 utilizes a spring loaded clothespin clamp that grasps the outer edges of each page and keeps them in tension by means of an elastic cord tied to each clamp but anchored in the backrest.

U.S. Pat. No. 3,813,307 utilizes a long elastic cord that stretches horizontally across the entire width of the open book and attaches both ends to the backrest, thus keeping the pages under pressure.

U.S. Pat. No. 3,952,989 utilizes along the top margin of each open page, 2 steel finger-like springs that press against each open page, and also uses two rectangular plates of transparent material applying pressure against the center face of each open page.

These six patents cited have one problem in common with each other; they require the use of two hands at least, to make a page turn. It is, therefore, one object of this invention to provide the reader with a book holder that not only keeps the pages of an open book flat and view un-obstructed, but also gives the reader a choice of turning pages with one hand or two hands.

Another object of this invention is to provide the reader with a bookholder that is simple in its construction yet inexpensive to manufacture.

A further object of this invention is to provide a book holder that is strong in its construction, yet is easily taken down without the necessity of tools and able to be carried in the arms or bag to the next reading site, and re-assembled without the necessity of tools. If need be, the dis-assembled book holder can be stored away on a closet shelf and take up a minimum of space.

Another object of this invention is to provide a book holder that is adaptable for use on a piano or organ or any keyboard instrument, for holding a music book open and yet making it possible to turn to the next page with one hand while the other hand is still playing music. In fact, this type of book holder is definitely usable for keeping sheet music in place on a music stand located out of doors on a windy day.

A further object of this invention is to provide a cookbook holder for the kitchen, that is able to stay open and flat, simple enough to turn pages with unclean hands, and yet able to be washed over and over again without damaging its parts or their ability to function properly.

Another object of this invention is to provide a book holder that works just as well with hard cover books as with soft cover books, or sheet music or magazines.

An important object of this invention is to provide a book holder that is respectful of the value attached to older and more fragile books. While some previous book holders look more like torture machines to an aging book, this book holder is not hazardous for their use.

DESCRIPTION OF INVENTION

Figure 1:
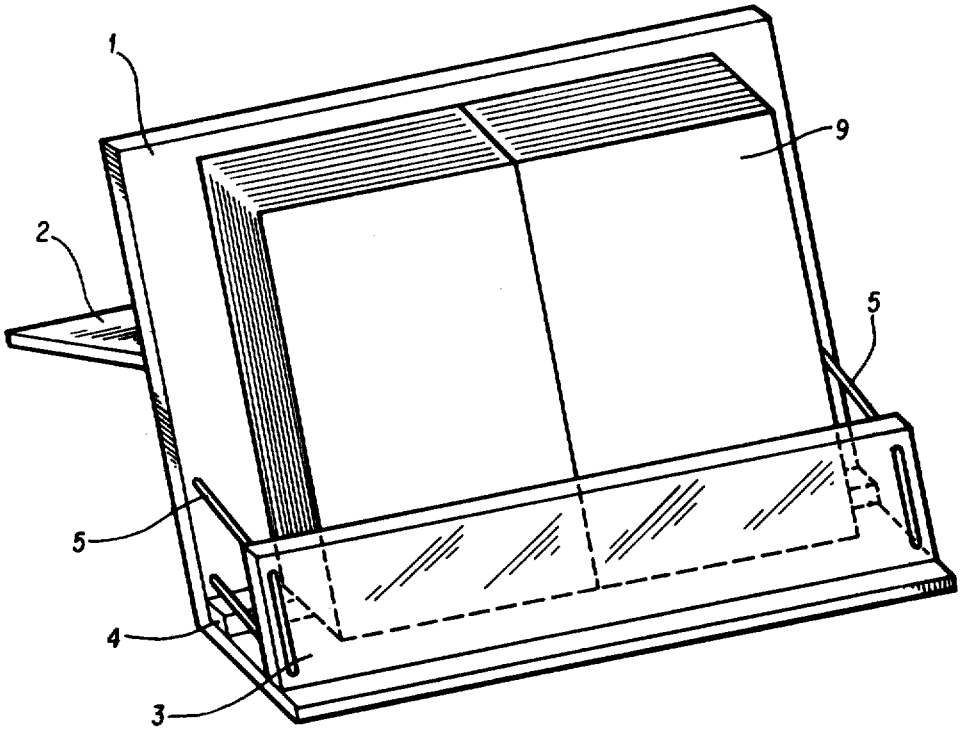
FIG. 1 is a front orthographic view of the book holder.
Figure 2:
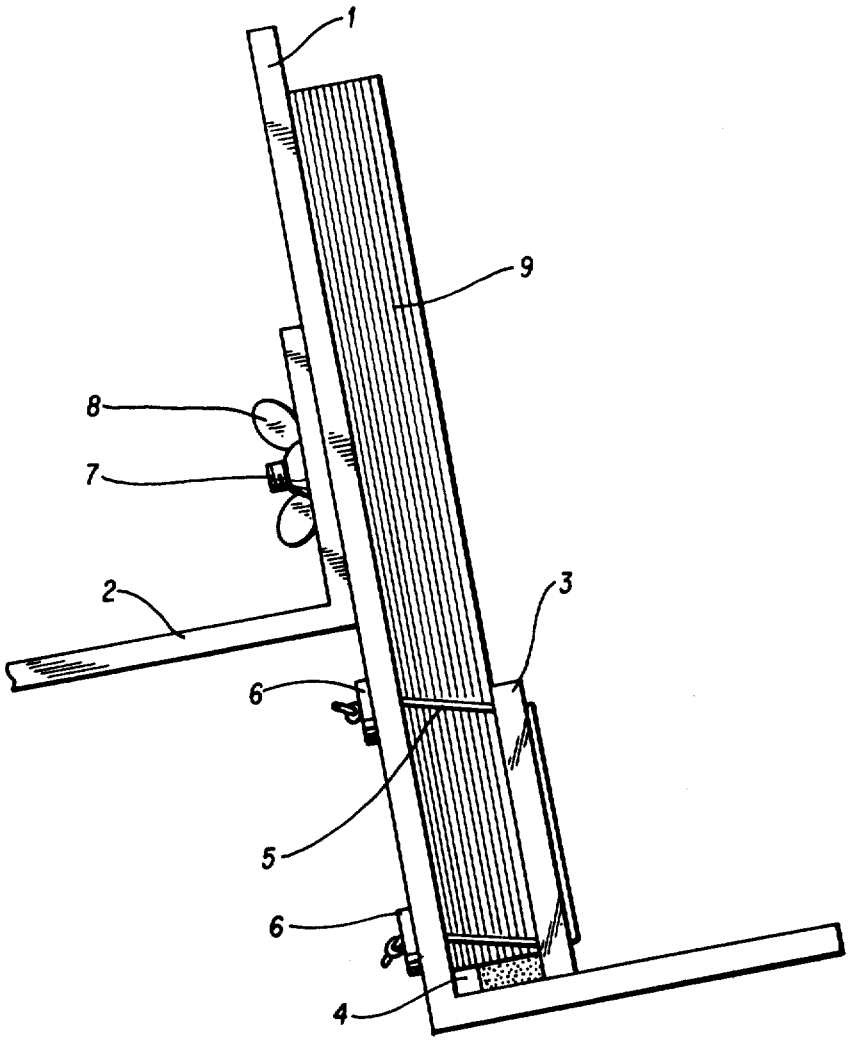
FIG. 2 is a side view of book holder with open book in reading position.
Figure 3:
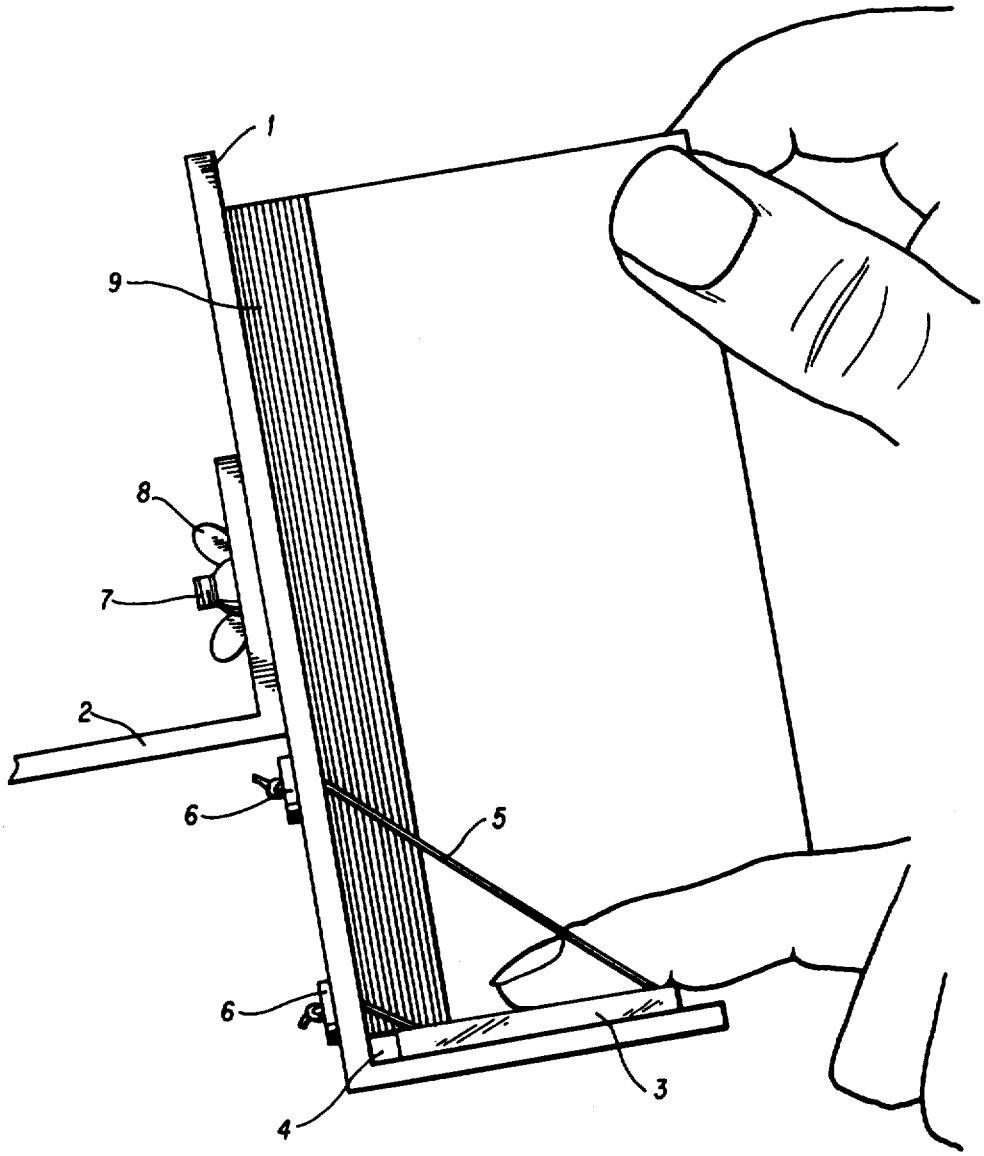
FIG. 3 is a side view of book holder with open book in place, and with the reader in the midst of turning a page with two hands.
Figure 4:
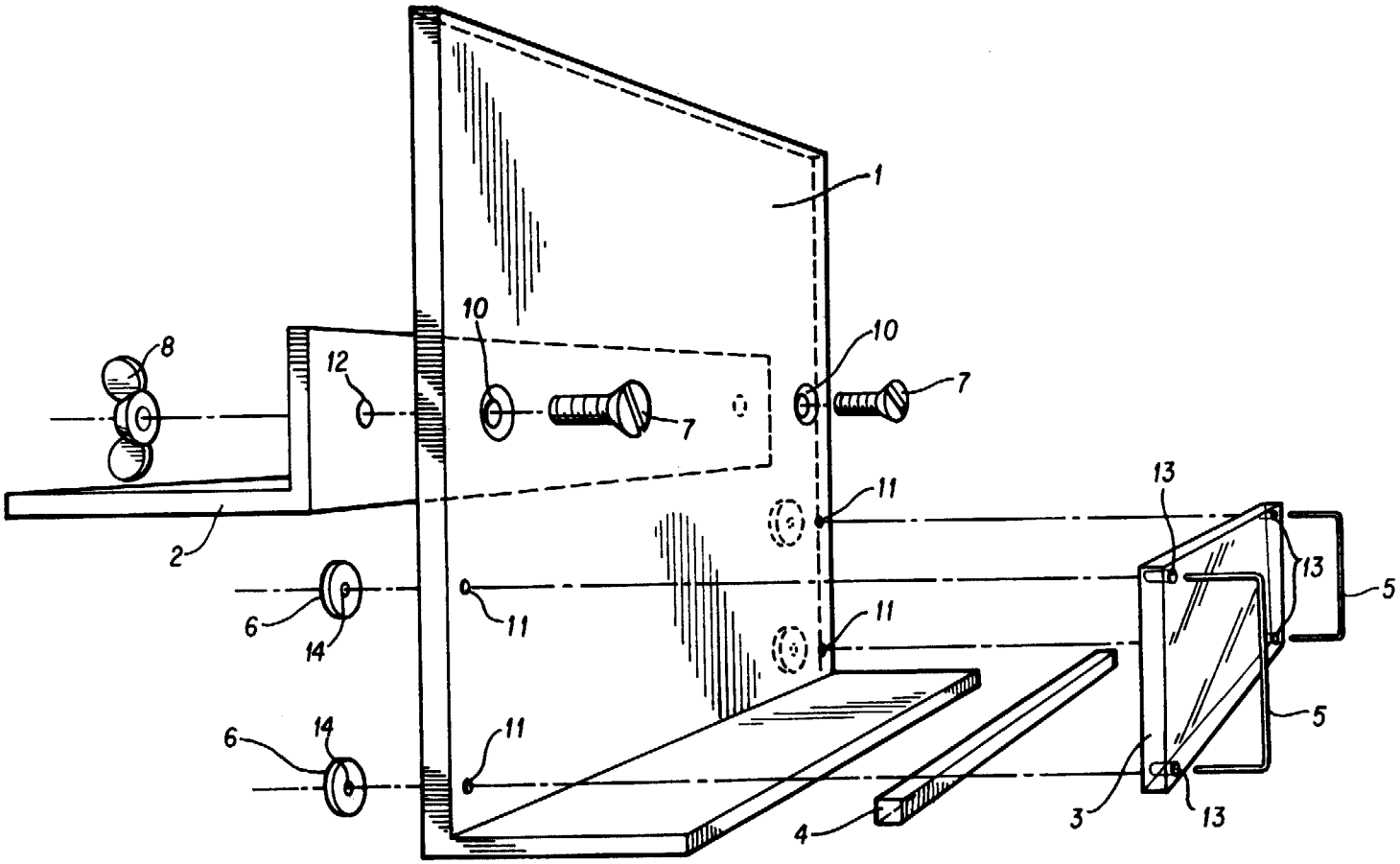
FIG. 4 is an exploded view of the book holder in perspective.

The book holder of this invention includes the backrest 1, which is a sheet of solid material bent into the form of an unequal right angle, with the short leg of the angle forming the base lip that supports the book 9. The backrest's rear support angle 2, is another sheet of solid material bent into the form of a right angle, with the short leg being used to attach to the back surface of backrest 1, and the long leg of said angle being of such a length as to rest upon the horizontal table top while keeping the backrest in an upright and rearwardly inclined position.

The rear support angle 2, is attached, in this example, to the backrest 1 by means of two machine bolts 7 and their matching wing nuts 8, for the purpose of portability. Said rear support angle could conceivably be attached permanently to the back surface of backrest 1 by means of cement or rivets or whatever materials are convenient.

The four holes 11, located along the vertical edges of backrest 1, are of such a diameter as to permit the elastic cord 5 to slide through said holes without binding. The location of said holes, with respect to a vertical centerline down the center of backrest 1, exactly matches the hole pattern in flat plate 3, when said plate is placed with its lower edge atop the spacer 4, and its back surface against the backrest 1.

About midway up the long leg of backrest 1, are located two holes 10, drilled through the material and having been countersunk at the front surface of said backrest for locating the two mounting bolts 7 which have slotted flat heads in order to keep them flush with the front surface of said backrest. The two holes 10, in the backrest 1, are so located about the vertical centerline, as to match the two holes 12 in the short leg of rear support angle 2. Said holes 12, are equally spaced about the vertical centerline of rear support angle and holes 12 are drilled through the material so that two bolts 7, can project out far enough on assembling, to receive their wing nuts 8, which can be tightened sufficiently by hand to keep the rear support angle secured to the backrest without the necessity for tools.

Located at the base of backrest 1 with base support lip, is the spacer 4, in the form of a square rod which extends horizontally the same distance as backrest 1 and flat plate 2. The height and width of said square rod, is exactly the same as the thickness of plate 3. Spacer 4 must have its top surface lying in the same plane as the top surface of plate 3 when said plate is lying flat on top of the base support lip. This spacer is in the form of a square rod obviously, but it could be replaced by other geometric shapes. Such as: round solid rod, or round hollow rod, or square hollow rod, or a right angle bracket. It could even conceivably be molded in place as an integral part of backrest 1 with base support lip, if such a backrest was to be made by the injection molding process. Different means could be used to fulfill the function of this spacer 4: providing a space, below the book's lower edges and above the top surface of the base support lip, in which to store temporarily the flat plate 3, out of the way of the moving page when the reader is in the process of turning a page over. For this book holder, spacer 4 is cemented in place.

Flat plate 3 consists of a rectangular transparent material whose horizontal width is the same as that of backrest 1. The thickness of said plate is the same as the height of spacer 4. The vertical height of said plate is not a critical dimension. Experience shows that the ratio of vertical height to horizontal width of flat plate 3 is approximately one over six. The material for flat plate 3 must be both transparent and thick enough to be able to press the many pages of a thick open book flat, without bending severely under the counter pressure.

The material for the following parts required for this book holder can be of sheet metal, plywood, natural wood, or non-transparent plastic sheet: backrest 1, rear support angle 2, spacer 4, and flat washers 6. In fact, it is possible to manufacture this book holder in such a way, using a flat sheet of clear plastic material, as to make in one integral part, the backrest with support lip 1, the spacer 4, and the rear supporting plate 2, out of one piece of material having the required number of bends as to function the same way as this book holder illustrated here.

The placement of holes 13 in flat plate 3 is such as to put the two left side holes as close to the left edge as possible without causing cracks to appear in the left margin, and as close to the top and bottom horizontal edges of plate 3, without causing cracks to appear in the top or bottom margins of said plate. The diameter of the four holes 13 in plate 3 is such as to permit the cotton covered elastic cords 5 to slide freely through the said holes without binding.

Elastic cord 5 is of sufficient length to be threaded by both ends simultaneously through holes 13 in the left edge of plate 3 in a rearward direction, then both ends of said cord are threaded through holes 11 in the backrest, then through holes 14 in both flat washers 6 in a rearward direction, then both ends of said cord are knotted after the rear surface of flat washers 6, and the excess cord length cut off after the knot. The same procedure is used for threading the elastic cord on the right edge of the book holder. The material of elastic cord 5 must be of rubber and covered over with a cotton fabric or substitute. (This material can be found commercially in any dress maker's supply store.)

Flat washers 6, can be made of a plastic material, or of metal, or natural wood or any economical substitute. The flat washer must be of sufficient diameter and thickness to support the pulling knotted cord when it is in tension. The center hole 14 in washer 6 must be of a size large enough to permit the entrance of cotton covered elastic cord 5 from either direction, forward or rearward, and yet the hole size must be small enough to not permit the elastic cord's knot to slip through said hole when the elastic cord is under tension. (Shirt buttons or beads could be used as emergency substitutes for washers 6.)

The amount of pressure which flat plate 3 exerts against the open pages of a book, can be increased or decreased by varying the working length of elastic cord 6 used, before terminating the cord ends with a knot at the rear surface of the flat washers 5.

The flat washers serve only one function, and that is to prevent the elastic cords from slipping out of their anchoring into the rear of backrest 1. A more economical means of anchoring the ends of said elastic cords might be by means of ears having two holes that clip onto the two vertical edges of the flat plate and the backrest. Or, the loose ends of the elastic cords could be attached to the back surface of the backrest with screws or nails or glue. Whatever means is chosen, it should permit the owner to be able to replace the elastic cords at any time should they break.

The foregoing is considered as illustrative only of the principles of the invention and though described as a blook holder, it is also suitable to hold magazines, sheet music and other reading matter. Further, since numerous modifications and changes will readily occur to those skilled in the art, it is not desired to limit the invention to the exact construction and operation shown and described, and accordingly all suitable modifications and equivalents may be resorted to falling within the scope of the invention as claimed.

OPERATION OF THE BOOK HOLDER

A book is placed and held securely in this book holder (using a right handed reader for example purposes only) first by grasping the flat plate 3 with the left hand and pulling said plate in a forward direction, stretching the elastic cords uniformly until there is created sufficient space behind the flat plate and in front of the backrest to fit the required thickness of the open book; second, by placing the book, being held by the reader's right hand in an open position, into said space just created, until the book is resting with its covers touching against the backrest and the book's lower edges being supported by the top surface of spacer 4; whereupon the last step is for the reader to gradually release his left hand's pulling force on the flat plate, letting said plate assume its most relaxed position: pressing against the open page's lower margins.

The procedure for turning a page, utilizing both the reader's hands, is as follows: starting with the open book in reading position and with the flat plate in vertical position pressing against the books's open pages at their lower margins, the reader's left hand will pull the upper left corner of plate 3 in a forward and downward arcing motion until said plate is pushed flat atop the book supporting lip, but beneath the book's lower edges, thus clearing a path for the moving page. The right side page is then placed over the left side page by the reader's right hand, provided of course that the reader's left hand holding down the plate is held out of the way of the moving page, over at the extreme left end of the reclining flat plate. Once the page turn has been completed by the reader's right hand, he can now release the downward force applied by his left hand onto the flat plate and permit said plate to revert back up to its normal reading position: pressing against the book's open pages' lower margins.

The procedure for turning a page utilizing only one of the reader's hands, his right hand for example, is as follows: starting as before with the open book in reading position and with flat plate in its normal book-reading position pressing against the open pages' lower margins, the reader's right hand will loosely grasp the upper right corner of the open book's right side page between his thumb and forefinger, slide those two fingers down the height of that same page until his right hand's pinky finger touches the upper right corner of flat plate 3. Now grasping the page firmly between those same two fingers, the pinky finger will push away the upper right corner of the flat plate with a forward and downward arcing motion until said plate is pushed into a reclining flat position on top of book support lip of backrest 1, but beneath the book's lower edges, thus clearing a path for the moving page. Without losing his two-fingered grip on the right page he wishes to turn, the reader will now slide his right hand along the up-facing surface of reclining flat plate, meanwhile keeping a constant downward pressure on the reclining flat plate as he moves his hand over to the extreme left end of the flt plate, carrying the moving page in his grasp all the while. He places the page upon the book's left side page, and releases his two-fingered grasp on the page. Now that the turned page has been put into its new position, the reader's right hand pinky finger can release the force it was exerting downwardly against the flat plate, and permit said plate to revert back up to its normal reading position: pressing against the book's open pages again at their lower margins.

While various changes may be made in the detail construction, it is understood that such changes will be within the spirit and scope of the present invention, as defined by the appended claims:

What is claimed is:

1. A book holder for supporting a book in an open position upon a horizontal surface, which holder comprising in combination a book supporting structure, consisting of an L-shaped backrest having a perpendicular support lip extending out from its base in a forward direction, said backrest is held in a rearwardly inclined vertical position by means of a back supporting plate; a book is leaned against said backrest's front surface but the book's weight is being supported by a base support lip with a spacer making contact with the book's lower edges, said spacer, being located at the intersection of the base of backrest's front surface and the rear of book support lip's top surface, is a means of holding the book's lower edges above the lip's top surface, thereby creating and maintaining a convenient storage space in which to place the flat plate temporarily, because it would otherwise be an impediment to a safe page turn when so desired by the reader; a rectangular flat plate of transparent material is flexibly supported in a horizontal normal working position in this book holder, with its back surface making contact with and pressing against the entire width of the open pages' lower margins, said flat plate providing a rearwardly exerting force against said open pages, said force being generated by means of elastics whose degree of tension is proportional to the thickness of the open book, said elastics, located at each extreme end of the flat plate, are threaded through holes in the flat plate and bypass the vertical edges of the open book, attach to the backrest, through which they also pass through holes, and are terminated and held captive by some means to the backside of the backrest; by varying the working length of each elastic used at the extreme ends of the flat plate, an additional means is provided by which the flat plate can vary its rearwardly exerting force applied against the pages of the open book.

2. The apparatus as claimed in claim 1 wherein said means of elastics comprises elastic cord members located at both the right end and the left end of said flat plate member.

* * * * *